US010325586B2

(12) United States Patent
Christoph

(10) Patent No.: US 10,325,586 B2
(45) Date of Patent: Jun. 18, 2019

(54) ACTIVE NOISE REDUCTION

(71) Applicant: Harman Becker Automotive Systems GmbH, Karlsbad (DE)

(72) Inventor: Markus Christoph, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 15/441,766

(22) Filed: Feb. 24, 2017

(65) Prior Publication Data

US 2017/0162184 A1 Jun. 8, 2017

Related U.S. Application Data

(63) Continuation of application No. 13/899,073, filed on May 21, 2013, now Pat. No. 9,583,090.

(30) Foreign Application Priority Data

May 21, 2012 (EP) ..... 12168685

(51) Int. Cl.

| | |
|---|---|
| ***G10K 11/16*** | (2006.01) |
| ***G10K 11/178*** | (2006.01) |
| ***G10K 11/175*** | (2006.01) |

(52) U.S. Cl.

CPC ..... *G10K 11/178* (2013.01); *G10K 11/175* (2013.01); *G10K 2210/1081* (2013.01);

(Continued)

(58) Field of Classification Search

CPC ... H04R 3/02; H04R 3/04; H04R 3/06; H04R 3/08; H04R 3/14; H04R 3/007;

(Continued)

(56) References Cited

U.S. PATENT DOCUMENTS 4,801,890 A 1/1989 Dolby
2004/0264706 A1* 12/2004 Ray ..... G10K 11/178 381/71.11

(Continued)

FOREIGN PATENT DOCUMENTS

CN 101184346 A 5/2008
CN 102460566 A 5/2012

(Continued)

OTHER PUBLICATIONS

Linkwitz "Shelving Low-Pass and High-Pass", image, www.linkwitzlab.com/images/graphics/shlv-lpf.gif, www.linkwitzlab.com/images/graphics/shlv-hpf.gif, Aug. 18, 2002, p. 1.*

(Continued)

*Primary Examiner* — Leshui Zhang
(74) *Attorney, Agent, or Firm* — Brooks Kushman P.C.

(57) ABSTRACT

A noise reducing comprises a first microphone that picks up noise signal at a first location and that is electrically coupled to a first microphone output path; a loudspeaker that is electrically coupled to a loudspeaker input path and that radiates noise reducing sound at a second location; a second microphone that picks up residual noise from the noise and the noise reducing sound at a third location and that is electrically coupled to a second microphone output path; a first active noise reducing filter that is connected between the first microphone output path and the loudspeaker input path; and a second active noise reducing filter that is connected between the second microphone output path and the loudspeaker input path; in which the first active noise reduction filter is a shelving or equalization filter or comprises at least one shelving or equalization filter or both.

24 Claims, 7 Drawing Sheets

(52) U.S. Cl.
CPC ..... *G10K 2210/3026* (2013.01); *G10K 2210/3027* (2013.01); *G10K 2210/3028* (2013.01); *G10K 2210/509* (2013.01)

(58) Field of Classification Search
CPC ..... H04R 5/04; H04R 25/453; H04R 25/50; H04R 25/505; H04R 25/507; H04R 1/1091; H04R 1/10; H04R 1/08; H04R 29/001; H04R 3/00; H04R 3/002; H04R 2420/07; H04R 2499/11; H04R 2217/03; H04R 2225/41; H04R 2225/43; H03G 5/00; H03G 5/005; H03G 5/16; H03G 5/165; H03G 5/24; H03G 5/28; H03G 9/005; H03G 9/24; H03G 9/025; H03G 2201/702; H03G 7/007; G06F 3/165; G06F 17/3074; G10K 11/175; G10K 11/16
USPC ..... 381/28, 59, 55, 317, 318, 321, 71.1, 381/71.14, 74, 83, 332, 93, 96, 97, 98, 381/99, 100, 101, 102, 103, 106, 107, 381/108, 120, 121; 327/551, 552, 553, 327/555, 560; 704/E21.007, E21.02, 704/E21.014; 379/406.01–406.16; 455/570; 700/94
See application file for complete search history.

(56) References Cited

U.S. PATENT DOCUMENTS

| | | | | |
|---|---|---|---|---|
| 2005/0041731 | A1* | 2/2005 | Azizi | H04B 3/145 375/229 |
| 2006/0188104 | A1 | 8/2006 | De Poortere | |
| 2008/0112570 | A1 | 5/2008 | Asada et al. | |
| 2009/0123003 | A1* | 5/2009 | Sibbald | G10K 11/178 381/71.14 |
| 2010/0014685 | A1* | 1/2010 | Wurm | G10K 11/178 381/71.11 |
| 2010/0131269 | A1 | 5/2010 | Park et al. | |
| 2010/0142718 | A1 | 6/2010 | Chin et al. | |
| 2010/0272283 | A1* | 10/2010 | Carreras | G10K 11/1788 381/71.6 |
| 2011/0007907 | A1 | 1/2011 | Park et al. | |
| 2011/0142247 | A1 | 6/2011 | Fellers et al. | |
| 2011/0211707 | A1 | 9/2011 | Fuller | |
| 2011/0235693 | A1 | 9/2011 | Lee et al. | |
| 2011/0293101 | A1 | 12/2011 | Park et al. | |
| 2012/0316872 | A1 | 12/2012 | Stoltz et al. | |

FOREIGN PATENT DOCUMENTS

| | | | |
|---|---|---|---|
| EP | 1921603 | A2 | 5/2008 |
| JP | 54110762 | A | 8/1979 |
| JP | 58040935 | | 3/1983 |
| JP | 03274895 | | 12/1991 |
| JP | 04150513 | | 5/1992 |
| JP | 05075382 | | 3/1993 |
| JP | 11305784 | A | 11/1999 |
| JP | 2005257720 | A | 9/2005 |
| JP | 2007500466 | A | 1/2007 |
| WO | 2009041012 | A1 | 4/2009 |
| WO | 2011006148 | A1 | 1/2011 |

OTHER PUBLICATIONS

Linkwitz, "Shelving Low-Pass and High-Pass filters", www.linkwitzlab.com/images/graphics/shlv-1pf.gif, Aug. 18, 2002, 1 page.
Holters et al., "Parametric Higher-Order Shelving Filters", 14th European Signal Processing Conference (EUSIPCO 2006), Florence, Italy, Sep. 4-8, 2006, 5 pages.
Linkwitz, "Active Filters", pp. 1-11, Jul. 2011, http://web.archive.org/web/20110713212444/htttp://www.linkwitzlab.com/filters.htm.
Japanese Office Action for Application No. 2013-063865, dated May 28, 2014, 7 pages.
Chinese Office Action for Application No. 201310194999.3, dated Nov. 24, 2015, 8 pages.
Linkwitz, "Shelving Low-Pass Filter", http://web.archive.org/web/20111013045704/http://linkwitzlab.com/images/graphics/shlv-hpf.gif, retrieved Oct. 13, 2011, 1 page.
Linkwitz, "Shelving High-Pass Filter", http://web.archive.org/web/20111013045704/http://linkwitzlab.com/images/graphics/shlv-hpf.gif, retrieved Oct. 13, 2011, 1 page.
European Search Report for Application No. 12168685.1, dated Sep. 14, 2012, 6 pages.
Japanese Office Action for Application No. 2014-164679, dated May 27, 2016, 4 pages.
Kataja et al., "Optimisation of digitally adjustable analogue biquad filters in feedback active control", Forum Acusticum, Budapest, 2005, 4 pages.
Nelder et al., "A simplex method for function minimization", The Computer Journal, 1965, pp. 308-313.
Hansen et al., "Active Control of Noise and Vibration", E & FN Spon, 1997, pp. 642-658.
Nelson, "Active Control of Sound", Academic Press, 1992, San Diego, CA, 232 pages.
Elliott, "Signal Processing for Active Control", Academic Press, 2001, 270 pages.
U.S. Office Action for U.S. Appl. No. 13/656,274, dated Dec. 8, 2014, 4 pages.
U.S. Office Action for U.S. Appl. No. 14/671,632, dated Apr. 7, 2016, 7 pages.
Chinese Office Action and English translation for Application No. 201310194999.3, dated Aug. 8, 2016, 15 pages.
Japanese Office Action and English translation for Application No. 2013-063865, dated Dec. 8, 2016, 8 pages.
U.S. Office Action for U.S. Appl. No. 13/899,073, dated Sep. 4, 2015, 13 pages.
U.S. Office Action for U.S. Appl. No. 13/899,073, dated Jan. 4, 2016, 13 pages.
U.S. Office Action for U.S. Appl. No. 13/899,073, dated Jun. 16, 2016, 12 pages.

* cited by examiner

ACTIVE NOISE REDUCTION

CROSS-REFERENCE TO RELATED APPLICATIONS

This application is a continuation of U.S. application Ser. No. 13/899,073 filed May 21, 2013, now U.S. Pat. No. 9,583,090, issued Feb. 28, 2017, which claims priority from EP Application No. 12 168 685.1-2225 filed May 21, 2012, the disclosures of which are hereby incorporated in their entirety by reference herein.

TECHNICAL FIELD

Disclosed herein is an active noise reduction system and, in particular, a noise reduction system which includes a feedback and a feedforward loop.

BACKGROUND

An active noise reduction system, also known as active noise cancellation/control (ANC) system, generally use a microphone to pick up an acoustic error signal (also called a "residual" signal) after the noise reduction, and feeds this error signal back to an ANC filter. This type of ANC system is called a feedback ANC system. The ANC filter in a feedback ANC system is typically configured to reverse the phase of the error feedback signal and may also be configured to integrate the error feedback signal, equalize the frequency response, and/or to match or minimize the delay. Thus, the quality of a feedback ANC system heavily depends on the quality of the ANC filter. The same problem arises with ANC systems having a so-called feedforward or other suitable noise reducing structure. A feedforward ANC system generates by means of an ANC filter a signal (secondary noise) that is equal to a disturbance signal (primary noise) in amplitude and frequency, but has opposite phase. Thus, there is a general need for providing ANC systems with an improved performance.

SUMMARY

A noise reducing system comprises a first microphone that picks up noise signal at first location and that is electrically coupled to a first microphone output path; a loudspeaker that is electrically coupled to a loudspeaker input path and that radiates noise reducing sound at a second location; a second microphone that picks up residual noise at a third location and that is electrically coupled to a second microphone output path; a first active noise reducing filter that is connected between the first microphone output path and the loudspeaker input path; and a second active noise reducing filter that is connected between the second microphone output path and the loudspeaker input path; in which the first active noise reduction filter is a shelving or equalizing filter or comprises at least one shelving or equalizing filter or both.

These and other objects, features and advantages of the present invention will become apparent in light of the detailed description of the embodiments thereof, as illustrated in the accompanying drawings. In the figures, like reference numerals designate corresponding parts.

DETAILED DESCRIPTION

Figure 1:
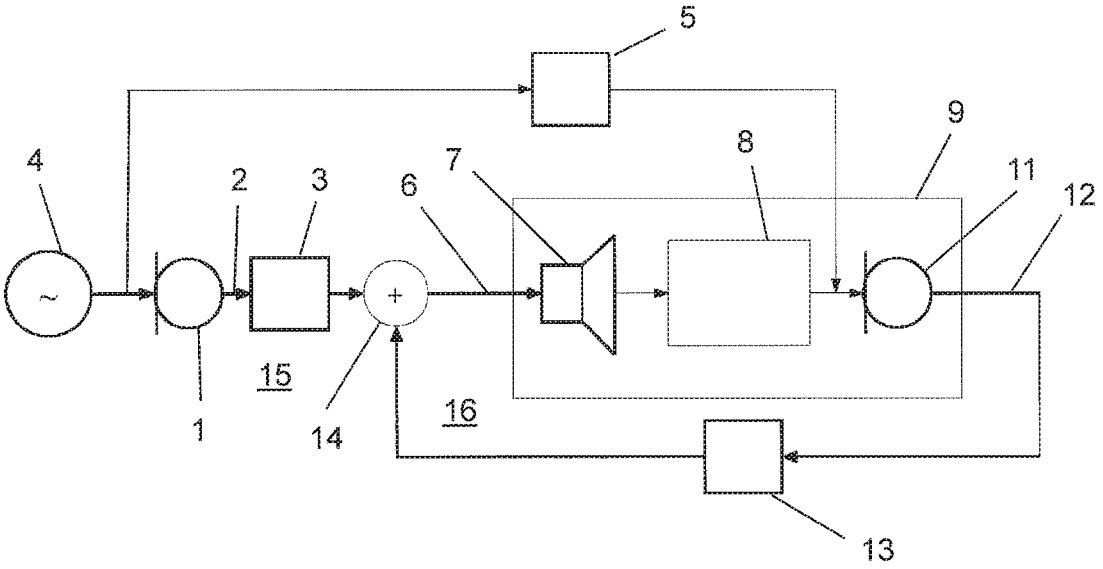
FIG. 1 is a block diagram illustration of a hybrid active noise reduction system in which a feedforward and feedback type active noise reduction system is combined.

Referring to FIG. 1, an improved noise reducing system includes a first microphone 1 that picks up at a first location a noise signal from, e.g., a noise source 4 and that is electrically coupled to a first microphone output path 2. A loudspeaker 7 is electrically coupled to a loudspeaker input path 6 and radiates noise reducing sound at a second location. A second microphone 11 that is electrically coupled to a second microphone output path 12 picks up residual noise at a third location, the residual noise being created by superimposing the noise received via a primary path 5 and the noise reducing sound received via a secondary path 8. A first active noise reducing filter 3 is connected between the first microphone output path 2 and via an adder 14 to loudspeaker input path 6. A second active noise reducing filter 13 is connected to the second microphone output path 12 and via the adder 14 to the loudspeaker input path 6. The second active noise reduction filter 13 is or comprises at least one shelving or equalizing (peaking) filter. These filter(s) may, for example, be a 2nd order filter structure.

In the system of FIG. 1, an open loop 15 and a closed loop 16 are combined, forming a so-called "hybrid" system. The open loop 15 includes the first microphone 1 and the first ANC filter 3. The closed loop 16 includes the second microphone 11 and the second ANC filter 13. The first and second microphone output paths 2 and 12 and the loudspeaker input path 6 may include analog amplifiers, analog or digital filters, analog-to-digital converters, digital-to-analog converters or the like which are not shown for the sake of simplicity. The first ANC filter 3 may be or may comprise at least one shelving or equalizing filter.

The shelving or equalizing filter of the first ANC filter may be an active or passive analog filter or a digital filter. The shelving filter in the second ANC filter may be an active or passive analog filter. For example, the first ANC filter may be or may comprise at least one digital finite impulse response filter. Analog and digital filters which are suitable are described below with reference to FIGS. 2-15.

The system shown in FIG. 1 has a sensitivity which can be described by the following equation:

$$N(z)=(H(z)-W_{OL}(z)\cdot S_{CL}(z)/(1-W_{CL}(z)\cdot S_{CL}(z)),$$

in which H(z) is the transfer characteristic of the primary path 5, $W_{OL}(z)$ is the transfer characteristic of the first ANC filter 3, $S_{CL}(z)$ is the transfer characteristic of the secondary path 8, and $W_{CL}(z)$ is the transfer characteristic of the second ANC filter 13. Advantageously, the first ANC filter 3 (open loop) and the second ANC filter 13 (closed loop) can easily be optimized separately.

Figure 2:
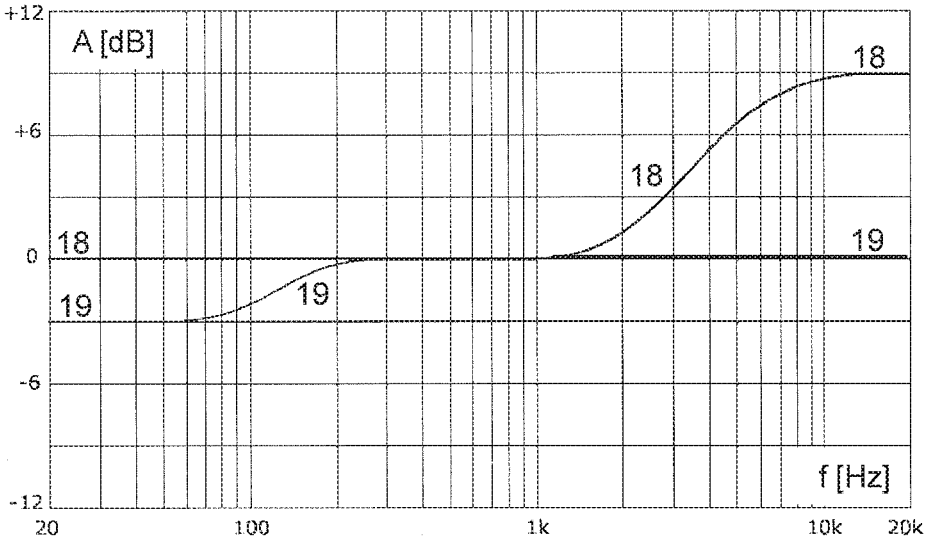
FIG. 2 is a magnitude frequency response diagram representing the transfer characteristics of shelving filters applicable in the system of FIG. 1.

FIG. 2 is a schematic diagram of the transfer characteristics 18, 19 of analog shelving filters applicable in the systems described above with reference to FIG. 1. In particular, a first order treble boost (+9 dB) shelving filter (18) and a bass cut (−3 dB) shelving filter (19) are shown. Although the range of spectrum shaping functions is governed by the theory of linear filters, the adjustment of those functions and the flexibility with which they can be adjusted varies according to the topology of the circuitry and the requirements that have to be fulfilled.

Single shelving filters are minimum phase (usually simple first-order) filters which alter the relative gains between frequencies much higher and much lower than the corner frequencies. A low or bass shelving filter is adjusted to affect the gain of lower frequencies while having no effect well above its corner frequency. A high or treble shelving filter adjusts the gain of higher frequencies only.

A single equalizer filter, on the other hand, implements a second-order filter function. This involves three adjustments: selection of the center frequency, adjustment of the quality (Q) factor, which determines the sharpness of the bandwidth, and the level or gain, which determines how much the selected center frequency is boosted or cut relative to frequencies (much) above or below the center frequency.

With other words: A low-shelving filter ideally passes ail frequencies, but increases or reduces frequencies below the shelving filter frequency by a specified amount. A high-shelving filter ideally passes all frequencies, but increases or reduces frequencies above the shelving filter frequency by a specified amount. An equalizing (EQ) filter makes a peak or a dip in the frequency response.

Figure 3:
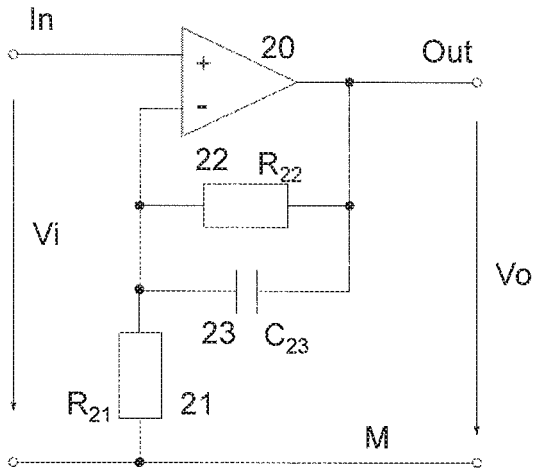
FIG. 3 is a block diagram illustration of an analog active 1st-order bass-boost shelving filter.

Reference is now made to FIG. 3 in which one optional filter structure of an analog active 1st-order bass-boost shelving filter is shown. The structure shown includes an operational amplifier 20 having an inverting input (−), a non-inverting input (+) and an output. A filter input signal In is supplied to the non-inverting input of the operational amplifier 20 and at the output of the operational amplifier 20 a filter output signal Out are provided. The input signal In and the output signal Out are (in the present and all following examples) voltages Vi and Vo that are referred to a reference potential M. A passive filter (feedback) network including two resistors 21, 22 and a capacitor 23 is connected between the reference potential M, the inverting input of the operational amplifier 20 and the output of the operational amplifier 20 such that the resistor 22 and the capacitor 23 are connected in parallel with each other and together between the inverting input and the output of the operational amplifier 20. Furthermore, the resistor 21 is connected between the inverting input of the operational amplifier 20 and the reference potential M.

The transfer characteristic H(s) over complex frequency s of the filter of FIG. 3 is:

$$H(s)=Z_o(s)/Z_i(s)=1+(R_{22}/R_{21})\cdot(1/(1+sC_{23}R_{22})),$$

in which $Z_i(s)$ is the input impedance of the filter, $Z_o(s)$ is the output impedance of the filter, $R_{21}$ is the resistance of the resistor 21, $R_{22}$ is the resistance of the resistor 22 and $C_{23}$ is the capacitance of the capacitor 23. The filter has a corner frequency $f_0$ in which $f_0=1/2\pi C_{23}R_{22}$. The gain G5 at lower frequencies (≈0 Hz) is $G_L=1+(R_{22}/R_{21})$ and the gain $G_H$ at higher frequencies (≈∞ Hz) is $G_H=1$. The gain GL and the corner frequency $f_0$ are determined, e.g., by the acoustic system used (loudspeaker-room-microphone system). For a certain corner frequency $f_0$ the resistances $R_{21}$, $R_{22}$ of the resistors 21 and 22 are:

$$R_{22}=1/2\pi f_0 C_{23}$$

$$R_{21}=R_{22}/(G_L-1).$$

As can be seen from the above two equations, there are three variables but only two equations so it is an overdetermined equation system. Accordingly, one variable has to be chosen by the filter designer depending on any further requirements or parameters, e.g. the mechanical size of the filter, which may depend on the mechanical size and, accordingly, on the capacity $C_{23}$ of the capacitor 23.

Figure 4:
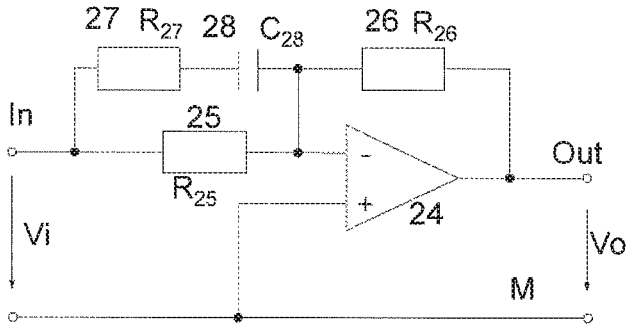
FIG. 4 is a block diagram illustration of an analog active 1st-order bass-cut shelving filter.

FIG. 4 illustrates an optional filter structure of an analog active 1st-order bass-cut shelving filter. The structure shown includes an operational amplifier 24 whose noninverting input is connected to the reference potential M and whose inverting input is connected to a passive filter network. This passive filter network is supplied with the filter input signal In and the filter output signal Out, and includes three resistors 25, 26, 27 and a capacitor 28. The inverting input of the operational amplifier 24 is coupled through the resistor 25 to the input signal In and through the resistor 26 to the output signal Out. The resistor 27 and the capacitor 28 are connected in series with each other and as a whole in parallel with the resistor 25, i.e., the inverting input of the operational amplifier 24 is also coupled through the resistor 27 and the capacitor 28 to the input signal In.

The transfer characteristic H(s) of the filter of FIG. 4 is:

$$H(s) = Z_o(s)/Z_i(s)$$

$$(s) = (R_{26}/R_{25})\cdot((1+sC_{28}(R_{25}+R_{27}))/(1+sC_{28}R_{27}))$$

in which $R_{25}$ is the resistance of the resistor 25, $R_{26}$ is the resistance of the resistor 26, $R_{27}$ is the resistance of the resistor 27 and $C_{28}$ is the capacitance of the capacitor 28. The filter has a corner frequency $f_0=1/2\pi C_{28}R_{27}$. The gain $G_L$ at lower frequencies (≈0 Hz) is $G_L=(R_{26}/R_{25})$ and the gain $G_H$ at higher frequencies (≈∞ Hz) is $G_H=R_{26}\cdot(R_{25}+R_{27})/(R_{25}\cdot R_{27})$ which should be 1. The gain $G_L$ and the corner frequency $f_0$ are determined, e.g., by the acoustic system used (loudspeaker-room-microphone system). For a certain corner frequency $f_0$ the resistances $R_{25}$, $R_{27}$ of the resistors 25 and 27 are:

$$R_{25}=R_{26}/G_L$$

$$R_{27}=R_{26}/(G_H-G_L).$$

The capacitance of the capacitor 28 is as follows:

$$C_{28}=(G_H-G_L)/2\pi f_0 R_{26}.$$

Again, there is an over-determined equation system which, in the present case, has four variables but only three equations. Accordingly, one variable has to be chosen by the filter designer, e.g., the resistance $R_{26}$ of the resistor 26.

Figure 5:
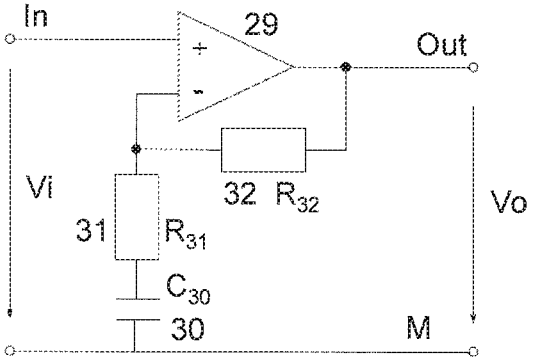
FIG. 5 is a block diagram illustration of an analog active 1st-order treble-boost shelving filter.

FIG. 5 illustrates an optional filter structure of an analog active 1st-order treble-boost shelving filter. The structure shown includes an operational amplifier 29 in which the filter input signal In is supplied to the non-inverting input of the operational amplifier 29. A passive filter (feedback) network including a capacitor 30 and two resistors 31, 32 is connected between the reference potential M, the inverting input of the operational amplifier 29 and the output of the operational amplifier 29 such that the resistor 31 and the capacitor 30 are connected in series with each other and together between the inverting input and the reference potential M. Furthermore, the resistor 32 is connected between the inverting input of the operational amplifier 29 and the output of the operational amplifier 29.

The transfer characteristic H(s) of the filter of FIG. 5 is:

$$H(s)=Z_o(s)/Z_i(s)=(1+sC_{30}(R_{31}+R_{32}))/(1+sC_{30}R_{31})$$

in which $C_{30}$ is the capacitance of the capacitor 30, $R_{31}$ is the resistance of the resistor 31 and $R_{32}$ is the resistance of the resistor 32. The filter has a corner frequency $f_0=1/2\pi C_{30}R_{31}$. The gain $G_L$ at lower frequencies (≈0 Hz) is $G_L=1$ and the gain $G_H$ at higher frequencies (≈∞ Hz) is $G_H=1+(R_{32}/R_{31})$. The gain $G_H$ and the corner frequency $f_0$ are determined, e.g., by the acoustic system used (loudspeaker-room-microphone system). For a certain corner frequency $f_0$ the resistances $R_{31}$, $R_{32}$ of the resistors 31 and 32 are:

$$R_{31}=1/2\pi f_0 C_{30}$$

$$R_{32}=R_{31}/(G_H-1).$$

Again, there is an over-determined equation system which, in the present case, has three variables but only two equations. Accordingly, one variable has to be chosen by the filter designer depending on any other requirements or parameters, e.g., the resistance $R_{32}$ of the resistor 32. This is advantageous because resistor 32 should not be made too small in order to keep the share of the output current of the operational amplifier flowing through the resistor 32 low.

Figure 6:
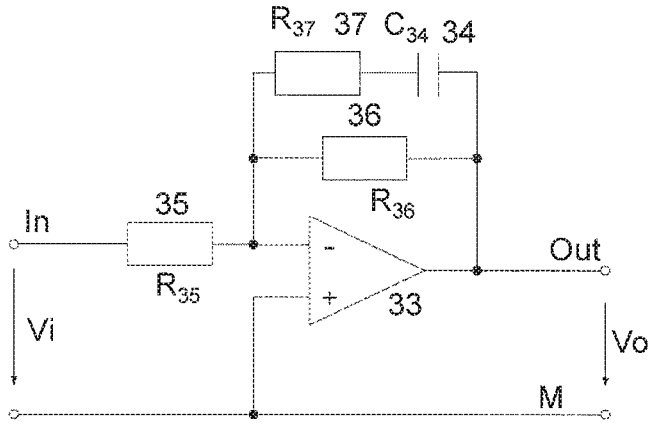
FIG. 6 is a block diagram illustration of an analog active 1st-order treble-cut shelving filter.

FIG. 6 illustrates an optional filter structure of an analog active 1st-order treble-cut shelving filter. The structure shown includes an operational amplifier 33 whose non-inverting input is connected to the reference potential M and whose inverting input is connected to a passive filter network. This passive filter network is supplied with the filter input signal In and the filter output signal Out, and includes a capacitor 34 and three resistors 35, 36, 37. The inverting input of the operational amplifier 33 is coupled through the resistor 35 to the input signal In and through the resistor 36 to the output signal Out. The resistor 37 and the capacitor 34 are connected in series with each other and as a whole in parallel with resistor 36, i.e., inverting input of the operational amplifier 33 is also coupled through the resistor 37 and the capacitor 34 to the output signal Out.

The transfer characteristic H(s) of the filter of FIG. 6 is:

$$H(s) = Z_o(s)/Z_i(s)$$
$$= (R_{36}/_{35})\cdot(1+sC_{34}R_{37})/(1+sC_{34}(R_{36}+R_{37}))$$

in which $C_{34}$ is the capacitance of the capacitor 34, $R_{35}$ is the resistance of the resistor 35, $R_{36}$ is the resistance of the resistor 36 and $R_{37}$ is the resistance of the resistor 37.

The filter has a corner frequency $f_0=1/2\pi C_{34}(R_{36}+R_{37})$. The gain $G_L$ at lower frequencies (≈0 Hz) is $G_L=(R_{36}/R_{35})$ and should be 1. The gain $G_H$ at higher frequencies (≈∞ Hz) is $G_H=R_{36}\cdot R_{37}/(R_{35}\cdot(R_{36}+R_{37}))$. The gain $G_L$ and the corner frequency $f_0$ are determined, e.g., by the acoustic system used (loudspeaker-room-microphone system). For a certain corner frequency $f_0$ the resistances $R_{35}$, $R_{36}$, $R_{37}$ of the resistors 35, 36 and 37 are:

$$R_{35}=R_{36}$$

$$R_{37}=G_H\cdot R_{36}/(1-G_H).$$

The capacitance of the capacitor 34 is as follows:

$$C_{34}=(1-G_H)/2\pi f_0 R_{36}.$$

The resistor 36 should not be made too small in order to keep the share of the output current of the operational amplifier flowing through the resistor 36 low.

Figure 7:
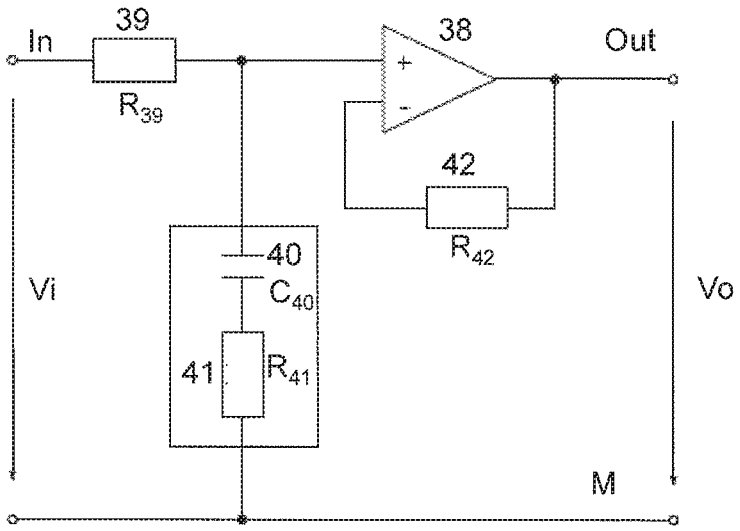
FIG. 7 is a block diagram illustration of an analog active 1st-order treble-cut shelving filter.

FIG. 7 illustrates an alternative filter structure of an analog active 1st-order treble-cut shelving filter. The structure shown includes an operational amplifier 38 in which the filter input signal In is supplied through a resistor 39 to the non-inverting input of the operational amplifier 38. A passive filter network including a capacitor 40 and a resistor 41 is connected between the reference potential M and the non-inverting input of the operational amplifier 38 such that the capacitor 30 and the resistor 41 are connected in series with each other and together between the non-inverting input and the reference potential M. Furthermore, a resistor 42 is connected between the inverting input and the output of the operational amplifier 38 for signal feedback.

The transfer characteristic H(s) of the filter of FIG. 7 is:

$$H(s)=Z_o(s)/Z_i(s)=(1+sC_{40}R_{41})/(1+sC_{40}(R_{39}+R_{41}))$$

in which $R_{39}$ is the resistance of the resistor 39, $C_{40}$ is the capacitance of the capacitor 40, $R_{41}$ is the resistance of the resistor 41 and $R_{42}$ is the resistance of the resistor 42. The filter has a corner frequency $f_0=1/2\pi C_{40}(R_{39}+R_{41})$. The gain $G_L$ at lower frequencies (≈0 Hz) is $G_L=1$ and the gain $G_H$ at higher frequencies (≈∞ Hz) is $G_H=R_{41}/(R_{39}+R_{41})<1$. The gain $G_H$ and the corner frequency $f_0$ may be determined, e.g., by the acoustic system used (loudspeaker-room-microphone system). For a certain corner frequency $f_0$ the resistances $R_{39}$, $R_{41}$ of the resistors 39 and 41 are:

$$R_{39}=G_H R_{42}/(1-G_H)$$

$$R_{41}=1-G_H)/2\pi f_0 R_{42}.$$

The resistor 42 should not be made too small in order to keep the share of the output current of the operational amplifier flowing through the resistor 42 low.

Figure 8:
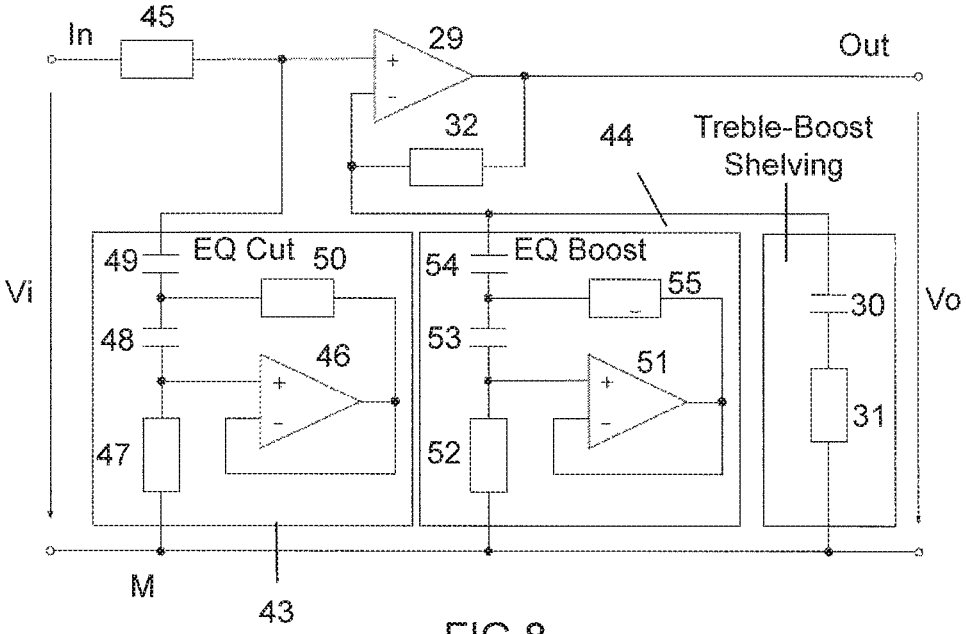
FIG. 8 is a block diagram illustration of an ANC filter including a shelving filter structure and additional equalizing filters.

FIG. 8 depicts an ANC filter that is based on the shelving filter structure described above in connection with FIG. 5 and that includes two additional equalizing filters 43, 44, one of which (e.g., 43) may be a cut equalizing filter for a first frequency band and the other may be a boost equalizing filter for a second frequency band. Equalization, in general, is the process of adjusting the balance between frequency bands within a signal.

The equalizing filter 43 includes a gyrator and is connected at one end to the reference potential M and at the other end to the non-inverting input of the operational amplifier 29, in which the input signal In is supplied to the non-inverting input through a resistor 45. The equalizing filter 43 includes an operational amplifier 46 whose inverting input and its output are connected to each other. The non-inverting input of the operational amplifier 46 is coupled through a resistor 47 to reference potential M and through two series-connected capacitors 48, 49 to the non-inverting input of operational amplifier 29. A tap between the two capacitors 48 and 49 is coupled through a resistor 50 to the output of operational amplifier 46.

The equalizing filter 44 includes a gyrator and is connected at one end to the reference potential M and at the other end to the inverting input of the operational amplifier 29, i.e., it is connected in parallel with the series connection of the capacitor 30 and the resistor 31. The equalizing filter 44 includes an operational amplifier 51 whose inverting input and its output are connected to each other. The non-inverting input of the operational amplifier 46 is coupled through a resistor 52 to reference potential M and through two series-connected capacitors 53, 54 to the inverting input of the operational amplifier 29. A tap between the two capacitors 53 and 54 is coupled through a resistor 55 to the output of the operational amplifier 51.

A problem with ANC filters in mobile devices supplied with power from batteries is that the more operational amplifiers that are used, the higher the power consumption is. An increase in power consumption, however, requires larger and thus more room consuming batteries when the same operating time is desired, or decreases the operating time of the mobile device when using the same battery types. One approach to further decreasing the number of operational amplifiers may be to employ the operational amplifier for linear amplification only and to implement the filtering functions with passive networks connected downstream (or upstream) of the operational amplifier (or between two amplifiers). An exemplary structure of such an ANC filter structure is shown in FIG. 9.

Figure 9:
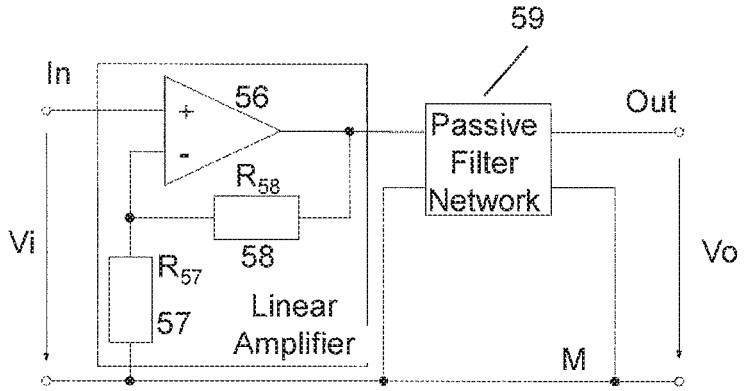
FIG. 9 is a block diagram illustration of an alternative ANC filter including a linear amplifier and a passive filter network.

In the ANC filter of FIG. 9, an operational amplifier 56 is supplied at its noninverting input with the input signal In. A passive, non-filtering network including two resistors 57, 58 is connected to the reference potential M and the inverting input and the output of the operational amplifier 56 forming a linear amplifier together with the resistors 57 and 58. In particular, the resistor 57 is connected between the reference potential M and the inverting input of the operational amplifier 56 and the resistor 58 is connected between the output and the inverting input of the operational amplifier 56. A passive filtering network 59 is connected downstream of the operational amplifier, i.e., the input of the network 59 is connected to the output of the operational amplifier 56. A downstream connection is more advantageous than an upstream connection in view of the noise behavior of the ANC filter in total. Examples of passive filtering networks applicable in the ANC filter of FIG. 9 are illustrated below in connection with FIGS. 10-13.

Figure 10:
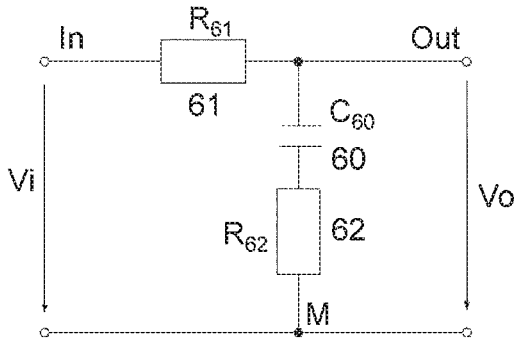
FIG. 10 is a block diagram illustration of an analog passive 1st-order bass (treble-cut) shelving filter.

FIG. 10 depicts a filter structure of an analog passive 1st-order bass (treblecut) shelving filter, in which the filter input signal In is supplied through a resistor 61 to a node at which the output signal Out is provided. A series connection of a capacitor 60 and a resistor 62 is connected between the reference potential M and this node. The transfer characteristic H(s) of the filter of FIG. 10 is:

$$H(s)=Z_o(s)/Z_i(s)=(1+sC_{60}R_{62})/(1+sC_{60}(R_{61}+R_{42}))$$

in which $C_{60}$ is the capacitance of the capacitor 60, $R_{61}$ is the resistance of the resistor 61 and $R_{62}$ is the resistance of the resistor 62. The filter has a corner frequency $f_0=1/2\pi C_{40}(R_{61}+R_{62})$. The gain $G_L$ at lower frequencies (≈0 Hz) is $G_L=1$ and the gain $G_H$ at higher frequencies (≈∞ Hz) is $G_H=R_{62}/(R_{61}+R_{62})$. For a certain corner frequency $f_0$ the resistances $R_{61}$, $R_{62}$ of the resistors 61 and 62 are:

$$R_{61}=(1-G_H)/2=f_0C_{60},$$

$$R_{62}=G_H/27\pi f_0C_{60}.$$

One variable has to be chosen by the filter designer, e.g., the capacitance $C_{60}$ of the capacitor 60.

Figure 11:
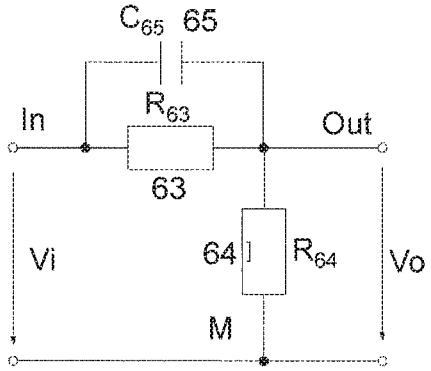
FIG. 11 is a block diagram illustration of an analog passive 1st-order treble (bass-cut) shelving filter.

FIG. 11 depicts a filter structure of an analog passive 1st-order treble (bass-cut) shelving filter, in which the filter input signal In is supplied through a resistor 63 to a node at which the output signal Out is provided. A resistor 64 is connected between the reference potential M and this node. Furthermore, a capacitor 65 is connected in parallel with the resistor 63. The transfer characteristic H(s) of the filter of FIG. 11 is:

$$H(S)=Z_o(s)/Z_i(s)=R_{64}(1+sC_{65}R_{63})/((R_{63}+R_{64})+sC_{65}R_{63}R_{64})$$

in which $R_{63}$ is the resistance of the resistor 63, $R_{64}$ is the resistance of the resistor 64 and $C_{65}$ is the capacitance of the capacitor 65. The filter has a corner frequency $f_0=(R_{63}+R_{64})/2\pi C_{65}R_{63}R_{64})$. The gain $G_H$ at higher frequencies (≈∞ Hz) is $G_H=1$ and the gain $G_L$ at lower frequencies (≈∞ Hz) is $G_L=R_{64}/(R_{63}+R_{64})$. For a certain corner frequency $f_0$ the resistances $R_{61}$, $R_{62}$ of the resistors 61 and 62 are:

$$R_{63}=1/2\pi f_0C_{65}G_L,$$

$$R_{64}=1/2\pi f_0C_{65}(1-G_L).$$

Figure 12:
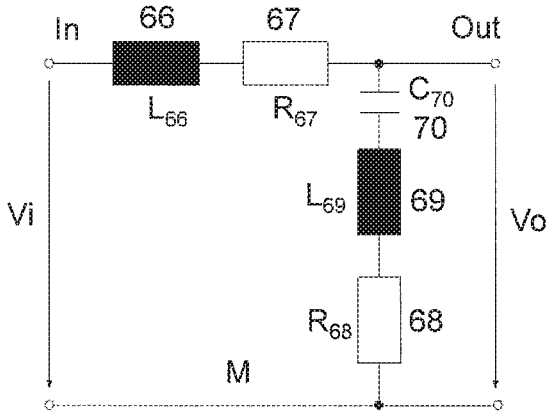
FIG. 12 is a block diagram illustration of an analog passive 2nd-order bass (treble-cut) shelving filter.

FIG. 12 depicts a filter structure of an analog passive 2nd-order bass (treble-cut) shelving filter, in which the filter input signal In is supplied through series connection of an inductor 66 and a resistor 67 to a node at which the output signal Out is provided. A series connection of a resistor 68, an inductor 69 and a capacitor 70 is connected between the reference potential M and this node. The transfer characteristic H(s) of the filter of FIG. 12 is:\

$$\begin{aligned}H(s) &= Z_o(s)/Z_i(s)\\ &= (1+sC_{70}R_{68}+s^2C_{70}L_{69})/(1+sC_{70}(R_{67}+R_{68})+\\ &\quad s^2C_{70}(L_{66}+L_{69}))\end{aligned}$$

in which $L_{66}$ is the inductance of the inductor 66, $R_{67}$ is the resistance of the resistor 67, $R_{68}$ is the resistance of the resistor 68, $L_{69}$ is the inductance of the inductor 69 and $C_{70}$ is the capacitance of the capacitor 70. The filter has a corner frequency $f_0=1/(2\pi(C_{70}(L_{66}+L_{69}))^{-1/2})$ and a quality factor $Q=(1/(R_{67}+R_{68}))\cdot((L_{66}+L_{69})/C_{70})^{-1/2})$. The gain $G_L$ at lower frequencies (≈0 Hz) is $G_L=1$ and the gain $G_H$ at higher frequencies (≈∞ Hz) is $G_H=L_{69}/(L_{66}+L_{69})$. For a certain corner frequency $f_o$ resistance $R_{67}$, capacitance $C_{70}$ and inductance $L_{69}$ are:

$$L_{69}=(G_HL_{66})/(1-G_H),$$

$$C_{70}=(1-G_H)/((2\pi f_0)^2L_{66}),\text{ and}$$

$$R_{68}=((L_{66}+L_{69})/C_{70})^{-1/2}-R_{67}Q)/Q.$$

Figure 13:
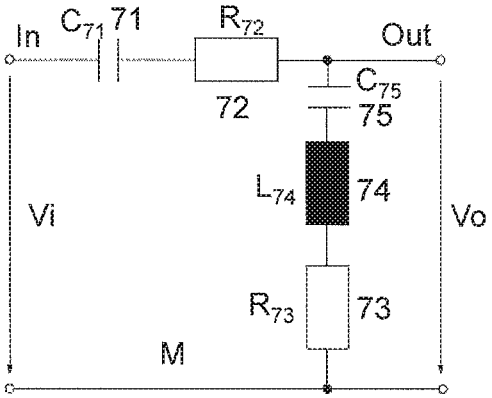
FIG. 13 is a block diagram illustration of an analog passive 2nd-order treble (bass-cut) shelving filter.

FIG. 13 depicts a filter structure of an analog passive 2nd-order treble (bass-cut) shelving filter, in which the filter input signal In is supplied through series connection of an capacitor 71 and a resistor 72 to a node at which the output signal Out is provided. A series connection of a resistor 73, an inductor 74 and a capacitor 75 is connected between the reference potential M and this node. The transfer characteristic H(s) of the filter of FIG. 13 is:

$$H(s) = Z_o(s)/Z_i(s)$$
$$= C_{71}(1 + sC_{75}R_{73} + s^2C_{75}L_{74})/((C_{71} + C_{75}) + sC_{71}C_{75}(R_{72} + R_{73}) + s^2C_{71}C_{75}L_{74})$$

in which $C_{71}$ is the capacitance of the capacitor 71, $R_{72}$ is the resistance of the resistor 72, $R_{73}$ is the resistance of the resistor 73, $L_{74}$ is the inductance of the inductor 74 and $C_{75}$ is the capacitance of the capacitor 75. The filter has a corner frequency $f_0=((C_{71}+C_{75})/(4\pi^2(L_{74}C_{71}C_{75}))^{-1/2}$ and a quality factor $Q=(1/(R_{72}+R_{73}))\cdot((C_{71}+C_{75})L_{74}/(C_{71}C_{75}))^{-1/2}$. The gain $G^H$ at higher frequencies ($\approx\infty$ Hz) is $G_H=1$ and the gain $G_L$ at lower frequencies ($\approx 0$ Hz) is $G_L=C_{71}/(C_{71}+C_{75})$. For a certain corner frequency $f_0$ resistance $R_{73}$, capacitance $C_{75}$ and inductance $L_{74}$ are:

$$C_{75}=(1-G_L)C_{71}/G_L,$$

$$L_{74}=1/((2\pi f_0)^2C_{71}(1-G_L)), \text{ and}$$

$$R_{73}=((L_{74}/(C_{70}(1-G_L)))^{-1/2}/Q)-R_{72}.$$

Inductors used in the examples above may be substituted by an adequately configured gyrator.

Figure 14:
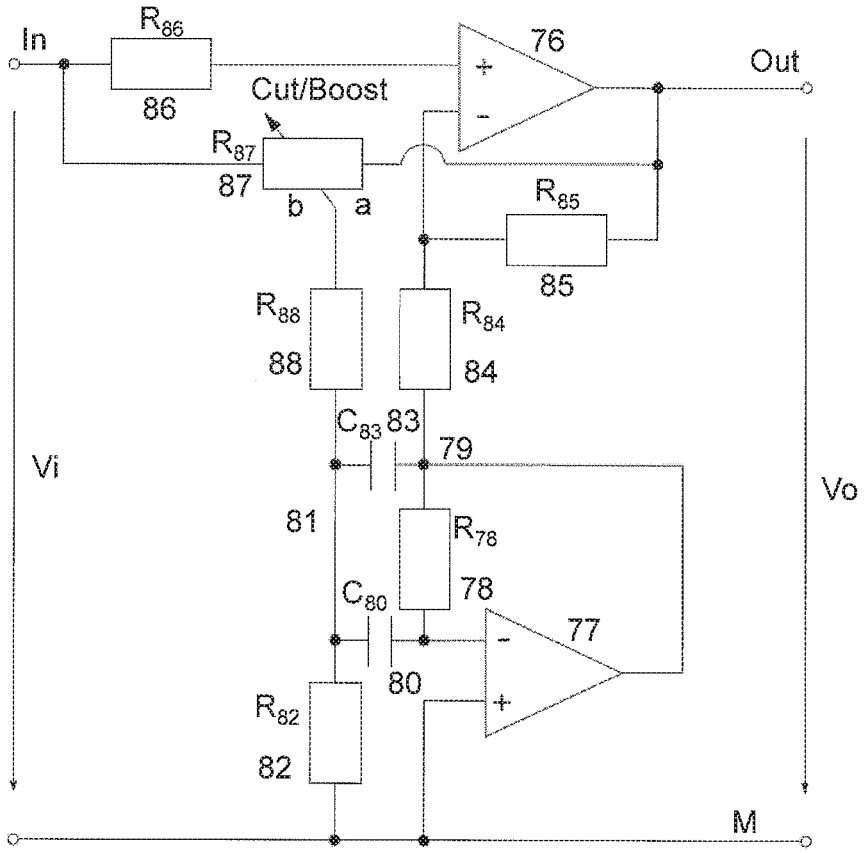
FIG. 14 is a block diagram illustration of a universal ANC (active) filter structure that is adjustable in terms of, boost or cut equalizing falter with high quality and/or low gain.

With reference to FIG. 14, a universal active filter structure is described that is adjustable in terms of boost or cut equalizing. The filter includes an operational amplifier 76 as a linear amplifier and a modified gyrator circuit. In particular, the universal active filter structure includes another operational amplifier 77, the non-inverting input of which is connected to reference potential M. The inverting input of operational amplifier 77 is coupled through a resistor 78 to a first node 79 and through a capacitor 80 to a second node 81. The second node 81 is coupled through a resistor 82 to the reference potential M, and through a capacitor 83 with the first node 79. The first node 79 is coupled through a resistor 84 to the inverting input of operational amplifier 76, its inverting input is further coupled to its output through a resistor 85. The non-inverting input of operational amplifier 76 is supplied through a resistor 86 with the input signal In. A potentiometer 87 forming an adjustable Ohmic voltage divider with two partial resistors 87*a* and 87*b* and having two ends and an adjustable tap is supplied at each end with input signal In and the output signal Out. The tap is coupled through a resistor 88 to the second node 81.

The transfer characteristic H(s) of the filter of FIG. 14 is:

$$H(s)=(b_0+b_1s+b_2s^2)/(a_0+a_1s+a_2s^2)$$

in which $$b_0=R_{84}R_{87a}R_{88}+R_{87b}R_{88}R+R_{87a}R_{88}R+R_{84}R_{87b}R_{88}+R_{84}R_{87b}R_{82}+R_{84}R_{87a}R_{82}+R_{84}R_{87a}R_{87}b+R_{87a}R_{87b}R+RR_{87b}R_{82}+RR_{87a}R_{82},$$

$$b1=R_{87a}C_{80}R_{82}RR_{88}+RC_{83}R_{88}R_{82}R_{87b}+R_{84}R_{87b}R_{88}C_{83}R_{82}+R_{87a}C_{83}R_{82}RR_{88}+R_{84}R_{87a}R_{88}C_{83}R_{82}+R_{84}R_{87a}R_{88}C_{80}R_{82}+R_{84}R_{87b}R_{88}C_{80}R_{82}+R_{87a}C_{80}R_{82}R_1R_{87b}+C_{80}R_{82}R_{78}RR_{87b}+R_{80}R_{88}R_{82}R_{87b}+R_{84}R_{87a}R_{87b}C_{83}R_{82}+R_{87a}C_{83}R_{82}RR_{87b},$$

$$b2=R_{87a}R_{82}R_{88}RC_{80}C_{83}R_{78}+RR_{87b}R_{88}C_{80}C_{83}R_{82}R_{78}+R_{84}R_{87b}R_{88}C_{80}C_{83}R_{82}R_{78}+R_{84}R_{87a}R_{88}C_{80}C_{83}R_{82}R_{78}+R_{84}R_{87a}R_{87b}C_{80}C_{83}R_{82}R_{78}+R_1R_{87a}R_{87b}C_{80}C_{83}R_{82}R_{78}.$$

$$a_0=R_{84}R_{87b}R_{82}+R_{84}R_{87a}R_{82}+R_{84}R_{87b}R_{88}+R_{84}R_{87a}R_{88}+R_{84}R_{87a}R_{87b},$$

$$a_1=R_{84}R_{87b}R_{88}C_{80}R_{82}+R_{84}R_{87a}R_{88}C_{83}R_{82}+R_{84}R_{87a}R_{88}C_{83}R_{82}+R_{84}R_{87a}R_{88}C_{80}R_{82}+R_{84}R_{87a}R_{87b}C_{83}R_{82}+R_{84}R_{87a}R_{87b}C_{80}R_{82}-R_{87a}R_{82}C_{80}RR_{78},$$

$$a_2=R_{84}R_{87b}R_{88}C_{80}C_{83}R_{82}R_{78}+R_{84}R_{87a}R_{88}C_{80}C_{83}R_{82}R_{78}+R_{84}R_{87a}R_{87b}C_{80}C_{83}R_{82}R_{78}.$$

in which a resistor X has a resistance Rx (X=78, 82, 84, 85, 86, 87a, 87b, 88), a capacitor Y has a capacitance $C_Y$ (Y=80, 83) and $R_{85}=R_{86}=R$.

Shelving filters in general and 2nd-order shelving filters in particular, beside equalization filters, require careful design when applied to ANC filters, but offer a lot of benefits such as, e.g., minimum phase properties as well as little space and energy consumption.

Figure 15:
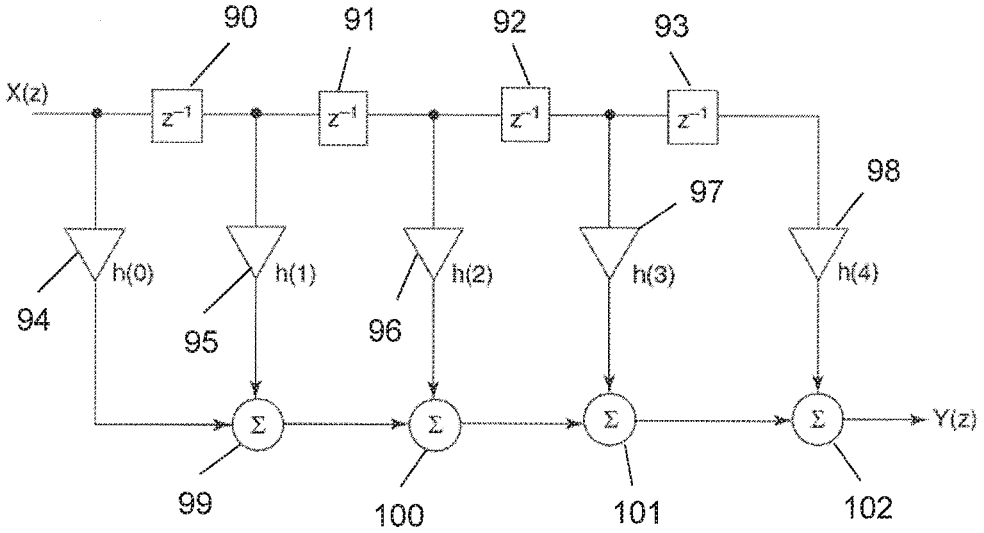
FIG. 15 is a block diagram illustration of a digital finite impulse response filter (FIR) applicable in the system of FIG. 1.

FIG. 15 illustrates a digital finite impulse response FIR filter which might be used as or in a first ANC filter 3 in the system of FIG. 1. The FIR filter includes, for instance, four series-connected delay elements 90-93 in which the first delay element in this series of delay elements 90-93 is supplied with a digital input signal X(z). The input signal x(z) and output signals of the delay elements 90-93 are fed through coefficient elements 94-98 each with a specific coefficient h(0), h(1)-h(4) to a summer or, as shown, to four summers 99-102 to sum up the signals from the coefficient elements 94-98 thereby providing an output signal Y(z). With the coefficients h(0), h(1)-h(4) the filter characteristic is determined, which may be a shelving characteristic or any other characteristic as, for instance an equalizing characteristic.

Figure 16:
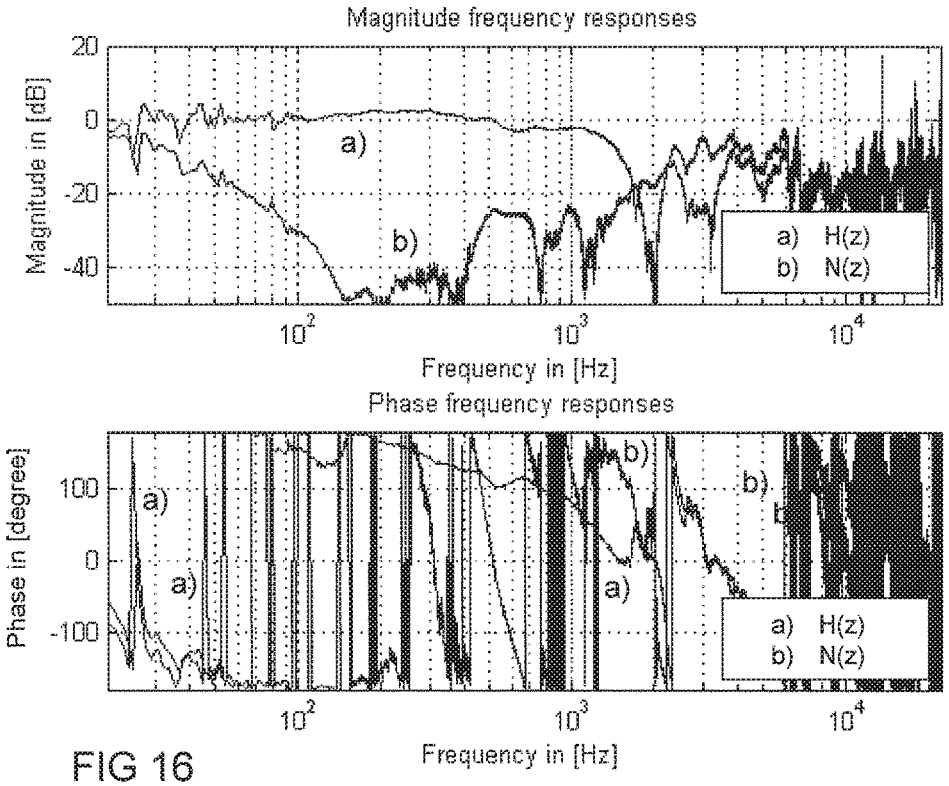
FIG. 16 is a Bode diagram depicting the transfer function of the primary path and the sensitivity function of the improved system.

As can be seen from FIG. 16, by combining an open loop system with a closed loop system a more distinctive attenuation characteristic in a broader frequency range can be achieved. In the upper diagram shown in FIG. 16, an exemplary frequency characteristic for the combined system is depicted as magnitude over frequency. The lower diagram in FIG. 16 depicts an exemplary phase characteristic as phase over frequency. Each diagram shows a) the passive transfer characteristic, i.e., the transfer characteristic H(z) of the primary path 5, and b) the sensitivity function N(z) of the combined open and closed loop system.

Figure 17:
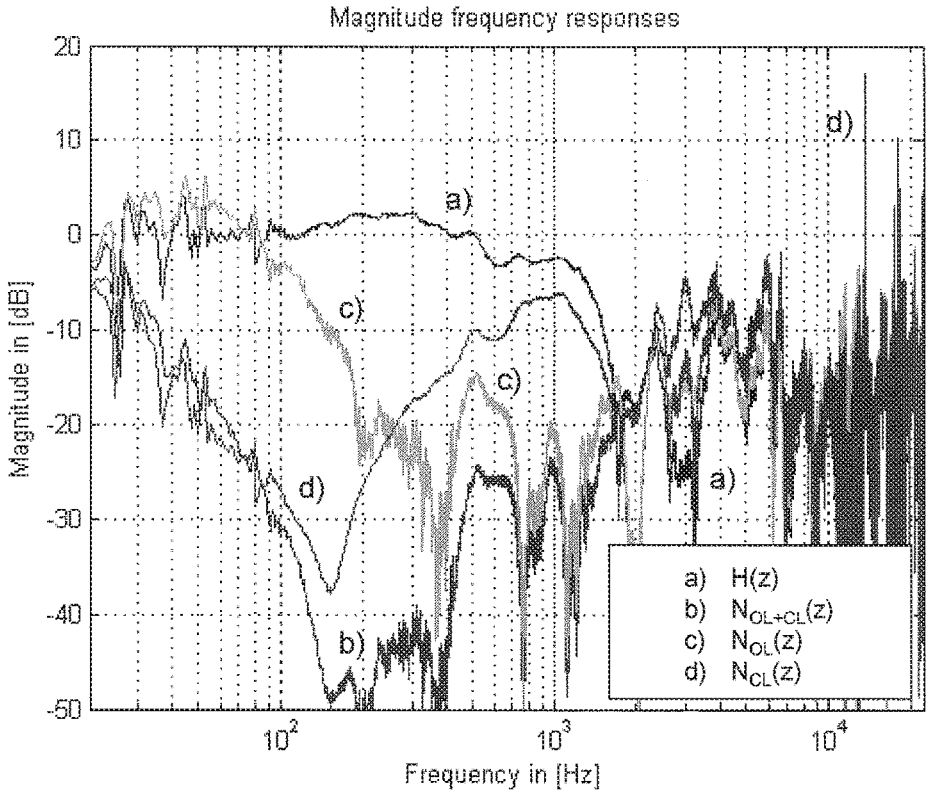
FIG. 17 is a diagram depicting the transfer function of the primary path and the sensitivity functions of the open loop system, the closed loop system and the combined, i.e. of the hybrid system.

The share of each of the open loop system 15 and the closed loop system 16 contributes to the total noise reduction is depicted in FIG. 17. The diagram depicts exemplary magnitude frequency responses of the transfer characteristic H(z) of the primary path and the sensitivity functions of the open loop system ($N_{OL}$), the closed loop system ($N_{CL}$) and the combined system ($N_{OL+CL}$). According to these diagrams, the closed loop system 16 is more efficient in the lower frequency range while the open loop system 15 is more efficient in the higher frequency range.

The system shown is suitable for a variety of applications such as, e.g., ANC headphones in which the second ANC filter is an analog filter and the first filter is an analog or digital filter.

Although various examples of realizing the invention have been disclosed, it will be apparent to those skilled in the art that various changes and modifications can be made which will achieve some of the advantages of the invention without departing from the spirit and scope of the invention. It will be obvious to those reasonably skilled in the art that other components performing the same functions may be suitably substituted. Such modifications to the inventive concept are intended to be covered by the appended claims.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A noise reducing system comprising:

a first microphone that picks up an acoustic noise at a first location and provides a first sensed signal indicative thereof to a first microphone output path;

a loudspeaker that is electrically coupled to a loudspeaker input path and that radiates noise reducing sound at a second location;

a second microphone that picks up residual noise from the noise and the noise reducing sound at a third location and provides a second sensed signal indicative thereof to a second microphone output path;

a first active noise reducing filter that is connected between the first microphone output path and the loudspeaker input path; and a second active noise reducing filter that is connected between the second microphone output path and the loudspeaker input path; in which:

the first active noise reducing filter comprises at least one shelving filter or equalizing filter, and the first active noise reducing filter operates at a frequency that is higher than a frequency at which the second active noise reducing filter operates.

2. The noise reducing system of claim 1, in which the at least one equalizing filter comprises at least one of an active analog filter or passive analog filter.

3. The noise reducing system of claim 2, in which the at least one equalizing filter comprises at least one of an active analog filter or passive analog filter.

4. The noise reducing system of claim 1, in which the at least one equalizing filter comprises a first linear amplifier and at least one passive filter network.

5. The noise reducing system of claim 4, in which a passive filter network forms a feedback path of the first linear amplifier.

6. The noise reducing system of claim 4, in which a passive filter network is connected in series with the first linear amplifier.

7. The noise reducing system of claim 1, in which the first active noise reducing filter comprises at least one equalizing filter.

8. The noise reducing system of claim 1, in which the first active noise reducing filter comprises a gyrator.

9. The noise reducing system of claim 1, in which the second active noise reducing filter comprises at least one additional equalizing filter.

10. The noise reducing system of claim 9, in which the at least one additional equalizing filter has at least a 2nd order filter structure.

11. The noise reducing system of claim 10, in which the at least one additional equalizing filter is an active analog filter or a passive analog filter.

12. The noise reducing system of claim 11, in which the first active noise reducing filter comprises at least one digital finite impulse response filter.

13. The noise reducing system of claim 1 in which the first active noise reducing filter comprises at least two equalizing filters, each of the at least two equalizing filters being a boost equalizing filter or a cut equalizing filter.

14. The noise reducing system of claim 1 wherein the at least one shelving filter or equalizing filter is a minimum phase filter.

15. The noise reducing system of claim 1, wherein the first active noise reducing filter operates in an open loop system.

16. The noise reducing system of claim 15, wherein the second active noise reducing filter operates in a closed loop system.

17. The noise reducing system of claim 16, wherein the first active noise reducing filter of the open loop system is combined with the second active noise reducing filter of the closed loop system to form a hybrid noise reducing system.

18. A noise reducing system comprising:

a first microphone that picks up an acoustic noise at a first location and provides a first sensed signal indicative thereof to a first microphone output path;

a loudspeaker that is electrically coupled to a loudspeaker input path and that radiates noise reducing sound at a second location;

a second microphone that picks up residual noise from the noise and the noise reducing sound at a third location and provides a second sensed signal indicative thereof to a second microphone output path;

a first active noise reducing filter that is connected between the first microphone output path and the loudspeaker; and a second active noise reducing filter that is connected between the second microphone output path and the loudspeaker input path; in which:

the first active noise reducing filter comprises at least one shelving filter or equalizing filter, and the first active noise reducing filter operates at a frequency that is higher than a frequency at which the second active noise reducing filter operates.

19. The noise reducing system of claim 18, in which the first active noise reducing filter comprises a gyrator.

20. The noise reducing system of claim 18, in which the second active noise reducing filter comprises at least one additional equalizing filter.

21. The noise reducing system of claim 20, in which the at least one additional equalizing filter has at least a 2nd order filter structure.

22. The noise reducing system of claim 20, in which the at least one additional equalizing filter is an active analog filter or a passive analog filter.

23. The noise reducing system of claim 18 in which the first active noise reducing filter comprises at least two equalizing filters, each of the at least two equalizing filters being a boost equalizing filter or a cut equalizing filter.

24. A noise reducing system comprising:

a first microphone that picks up an acoustic noise and provides a first sensed signal indicative thereof to a first microphone output path;

a loudspeaker that is electrically coupled to a loudspeaker input path and that radiates noise reducing sound;

a second microphone that picks up residual noise from the noise and the noise reducing sound and provides a second sensed signal indicative thereof to a second microphone output path;

a first active noise reducing filter that is connected between the first microphone output path and the loudspeaker input path; and a second active noise reducing filter that is connected between the second microphone output path and the loudspeaker input path; in which:

the first active noise reducing filter comprises at least one shelving filter or equalizing filter, and the first active noise reducing filter operates at a frequency that is higher than a frequency at which the second active noise reducing filter operates.

* * * * *